US008147273B2

(12) United States Patent
Rabbe et al.

(10) Patent No.: US 8,147,273 B2
(45) Date of Patent: Apr. 3, 2012

(54) CONNECTOR FOR HIGH ELECTRICAL POWER APPLICATIONS

(75) Inventors: Klaus Rabbe, Hoexter (DE); Christian Neese, Bielefeld (DE); Martin Drewes, Paderborn (DE); Reiner Tepe, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/777,980

(22) Filed: May 11, 2010

(65) Prior Publication Data

US 2010/0297891 A1 Nov. 25, 2010

(30) Foreign Application Priority Data

May 22, 2009 (DE) ..... 20 2009 007 276 U

(51) Int. Cl.
*H01R 13/648* (2006.01)

(52) U.S. Cl. ..... 439/607.06

(58) Field of Classification Search ..... 439/610, 439/607.06, 608, 609, 101, 108, 465, 466, 439/467

See application file for complete search history.

(56) References Cited

U.S. PATENT DOCUMENTS 3,701,083 A * 10/1972 Ziegler, Jr. ..... 439/248
4,272,148 A 6/1981 Knack, Jr.
6,017,245 A * 1/2000 Karir ..... 439/607.45
6,354,879 B1 * 3/2002 Plehaty ..... 439/607.41
7,326,091 B2 * 2/2008 Nania et al. ..... 439/681

FOREIGN PATENT DOCUMENTS

| | | | |
|---|---|---|---|
| DE | 20301293 | U1 | 6/2003 |
| DE | 202004004297 | U1 | 11/2004 |
| DE | 102008052327 | A1 | 6/2009 |
| EP | 0421373 | A1 | 4/1991 |
| EP | 0595234 | A1 | 5/1994 |
| EP | 0649191 | A1 | 4/1995 |
| EP | 2003741 | A1 | 12/2008 |
| WO | 9222943 | A1 | 12/1992 |

* cited by examiner

*Primary Examiner* — Tulsidas C Patel
*Assistant Examiner* — Phuongchi Nguyen
(74) *Attorney, Agent, or Firm* — Lawrence E. Laubscher, Sr.; Lawrence E. Laubscher, Jr.

(57) ABSTRACT

A connector assembly includes a preassembly frame to which the ends of a number of high-voltage transmission lines are connected, whereupon the preassembly frame is mounted in an open-ended chamber contained in a connector housing. The frame includes a first end wall having openings that receive intermediate portions of the transmission lines, which first end wall carries a grounding plate having projections for engaging exposed portions of braided shielding layers of the transmission lines. The free ends of the transmission lines are provided with contact members that are supported by insulation sleeves in wall openings contained in a second end wall of the preassembly frame. A coding arrangement prevents the connector assembly from being connected to an unauthorized companion electrical device.

8 Claims, 10 Drawing Sheets

CONNECTOR FOR HIGH ELECTRICAL POWER APPLICATIONS

BACKGROUND OF THE INVENTION

1. Field of the Invention

A connector assembly includes a preassembly frame to which the ends of a number of high-voltage transmission lines are connected, whereupon the preassembly frame is mounted in an open-ended chamber contained in a connector housing. The frame includes a first end wall having openings that receive intermediate portions of the transmission lines, which first end wall carries a grounding plate having projections for engaging exposed portions of braided shielding layers of the transmission lines. The free ends of the transmission lines are provided with contact members that are supported by insulation sleeves in wall openings contained in a second end wall of the preassembly frame. A coding arrangement prevents the connector assembly from being connected to an unauthorized companion electrical device.

2. Description of Related Art

To transmit high-voltage power outputs, it is necessary so to design connector arrangements that one can make sure, with maximum probability, that the assembly of the housing will not cause the contacts to be bent, twisted or shifted, or perhaps even separated. Besides, the contacting of any possible sheaths of the conductors is a problem that so far has been solved only inadequately.

Against this background, it is the object of the present invention to solve the two abovementioned problems in each case independently of each other. According to a preferred embodiment, a connector arrangement is also to be created where the two mentioned problems are solved together.

SUMMARY OF THE INVENTION

Accordingly, a primary object of the invention is to provide a connector arrangement including a rigid preassembly frame to which the ends of a plurality of insulated and shielded transmission lines are connected, which frame is subsequently mounted in a protective outer housing. Prior to assembly in the housing, exposed portions of the braided electrically conductive shielding layers of the transmission lines are connected with a grounding plate fastened to a first end wall of the preassembly frame. The free ends of the transmission lines are supported in openings contained in the second end wall of the preassembly frame by cylindrical contact members crimped or otherwise fastened to the bare ends of the transmission line core conductors, and by tubular insulation sleeves arranged concentrically about the contact members.

According to a more specific object of the invention, coding means are provided for preventing connection of the connector arrangement to an unauthorized electrical device, such as a companion connector arrangement.

According to another object of the invention, the connector arrangement is characterized by the provision of a rigid frame on which the conductors and the contacts can be preassembled and which can be placed in the protective housing in the preassembled state. The frame first of all constitutes a stable assembly space or limits such a space in which the conductors and the contacts can be connected with each other. Optionally, a ground plate is also placed in the frame in a conducting manner for engagement with the braided shielding layers of the transmission lines. Only then is the unit, thus preassembled, inserted in the housing, or only then is the housing preferably pushed up upon the frame. The frame prevents the elements that are preassembled in or around the frame from being jiggled or damaged during the assembly of the housing.

In particular, the free ends of the transmission line core leads of the transmission lines are connected with the frame by means of contact members fastened to the core conductor bare ends, respectively. Optionally, moreover, the shielding layer contacting device for contacting of one or more transmission line sheaths is arranged in the frame.

Here it is practical when the housing is a circumferentially enclosed casing with a preferably rectangular cross-section. This casing is furthermore preferably laterally open at its two axial ends and can be pushed upon the frame.

In a preferred variant, the frame has two base plates that are aligned parallel to each other and that are connected with each other by means of studs in the area of their corners. This frame is designed to be stable and can be put together with simple means during the assembly of the patch plug.

With regard to the sheath-contacting device, it is provided that the latter preferably have contact projections that engage on the outside against the shielding sheath layer, whereby the conductors and the contact projections bridges are bordered by attachment means such as preferably metallic screw-operated hose clamps or metal cable clamps with which the contact projections are pressed against the braided sheaths of the transmission lines. At this point, it is furthermore particularly advantageous when the sheath-contacting device has a ground plate with integral contact projections.

The sheath-contacting device makes it possible in a simple manner to contact the braided conductive sheath layer securely and quickly, specifically in such a way that the conducting connection will also be suitable for the temporary shunting of higher outputs.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
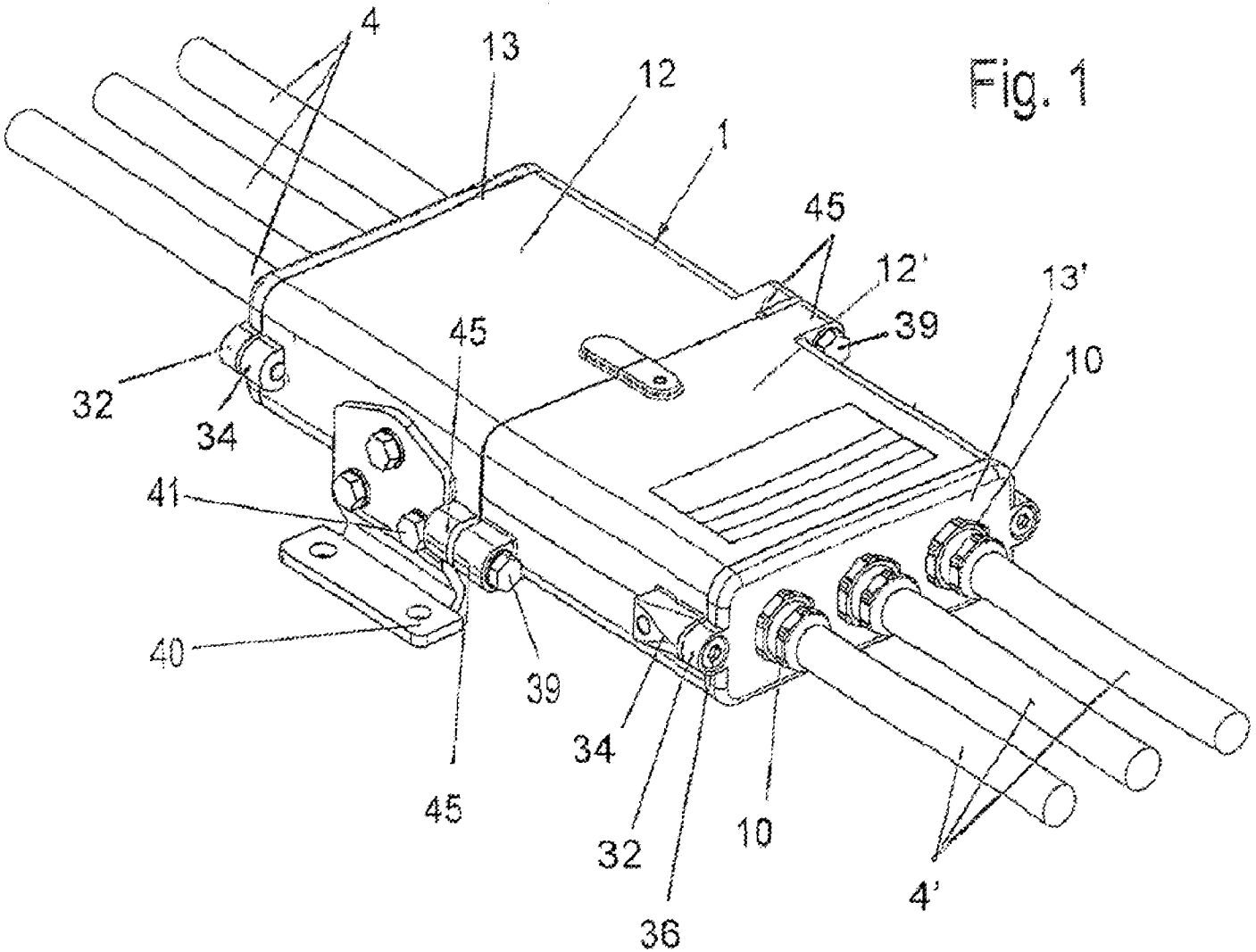
FIG. 1 is a perspective view of a connector assembly for high voltage transmission lines.

Referring first more particularly to FIG. 1, the connector arrangement includes a sectional housing 1 3 including having a pair of housing sections 12 and 12' that are fastened together by integral ear portions 45, and connecting bolts 39 that extend through aligned threaded bores contained in the housing ear portions. The housing assembly is fastened to a fixed support by L-shaped foot means 40 that are bolted to opposite sides of the assembly by bolts 41. A plurality of high-voltage high-power insulated and shielded transmission lines 4 and 4' are connected adjacent their free ends by threaded fastening nuts 10 with preassembly frame end walls 13, 13' at each end of the assembly, as will be described in greater detail below.

Figure 2:
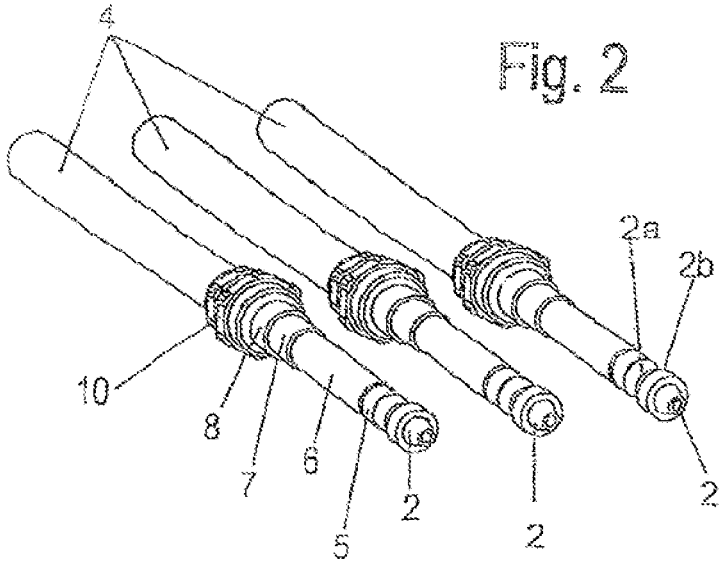
FIG. 2 is a perspective view of the contact members fastened to the bare ends of the transmission lines of FIG. 1.
Figure 11:
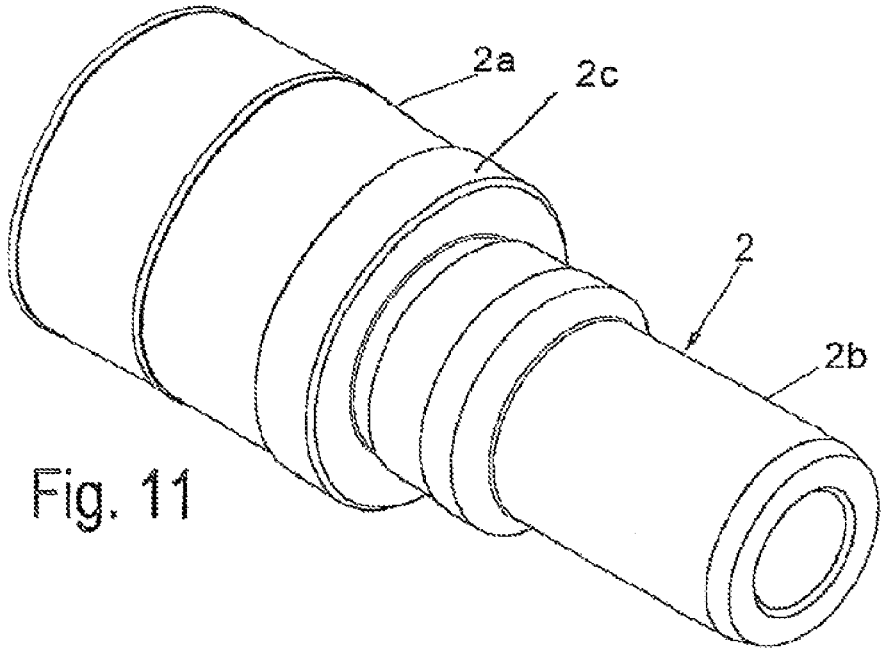
FIGS. 11 and 12 are front perspective views of male and female contact members.
Figure 12:
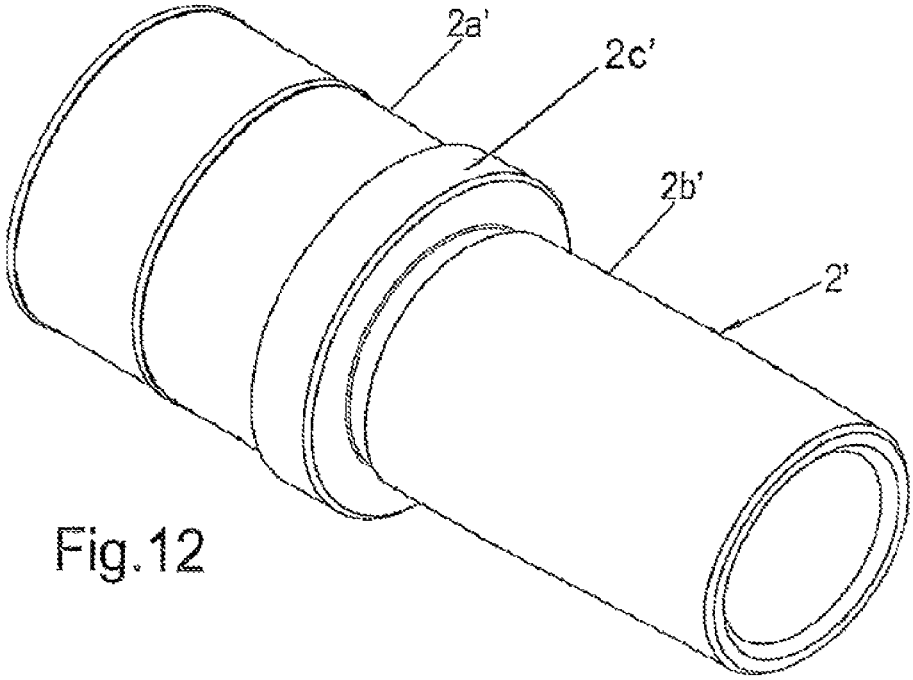

Referring to FIG. 2, it will be seen that each of the insulated transmission lines 4 includes a core conductor 5 concentrically surrounded by a first layer of insulation material 6, a braided conductive metal shielding layer 7, and an outer insulation layer 8. Mounted on the stripped bare ends of the core conductors 5 are a plurality of cylindrical contact members 2 having tubular first ends 2*a* (FIG. 11) that are crimped or soldered to the bare core conductors, respectively. As best shown in FIG. 11, the contact members 2 comprise male contacts having at their other ends male contact portions 2*b*, and an intermediate portion 2*c*. In the modification of FIG. 12, the contact members 2' are female contact members having a tubular crimping end 2*a'*, a female contact end 2*b'*, and an intermediate portion 2*c'*.

Figure 5:
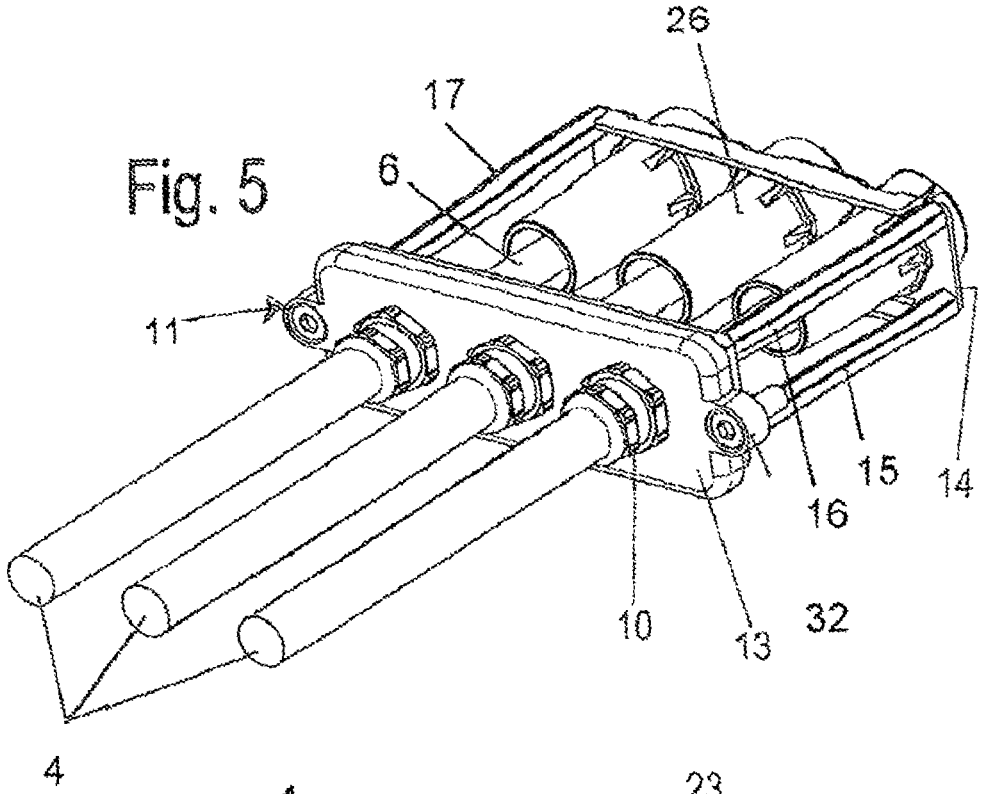
FIG. 5 is an outer rear perspective view of the assembled preassembly frame.
Figure 6:
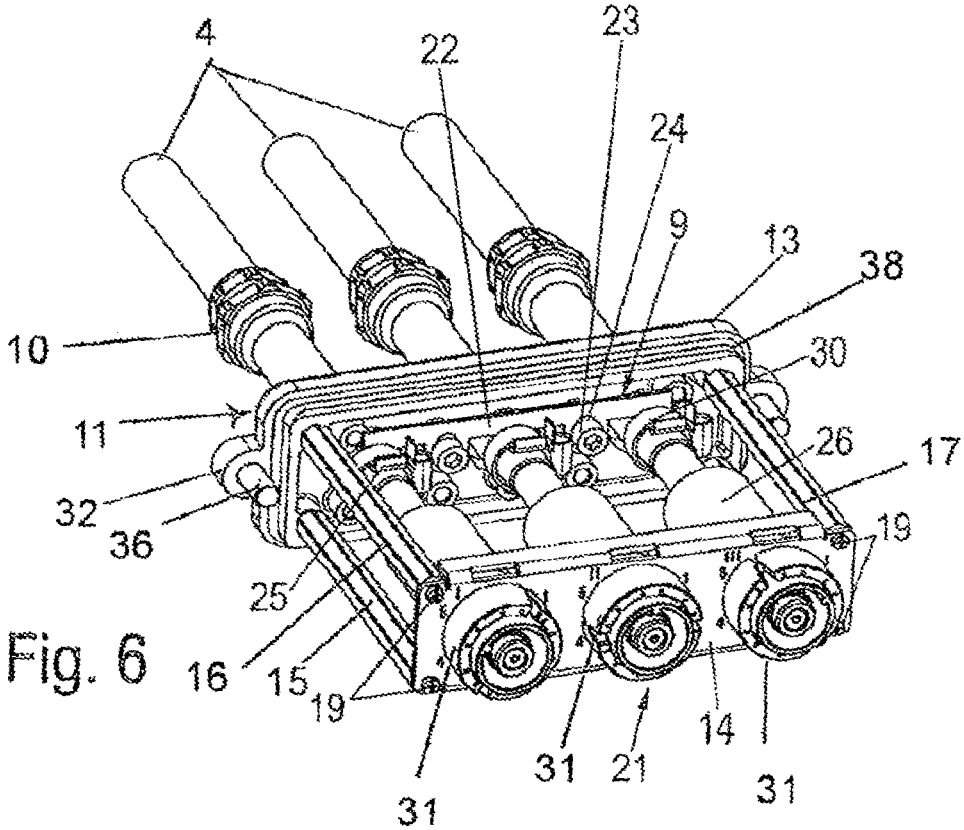
FIG. 6 is a outer front perspective view of the assembled preassembly frame.
Figures 7, 7A:
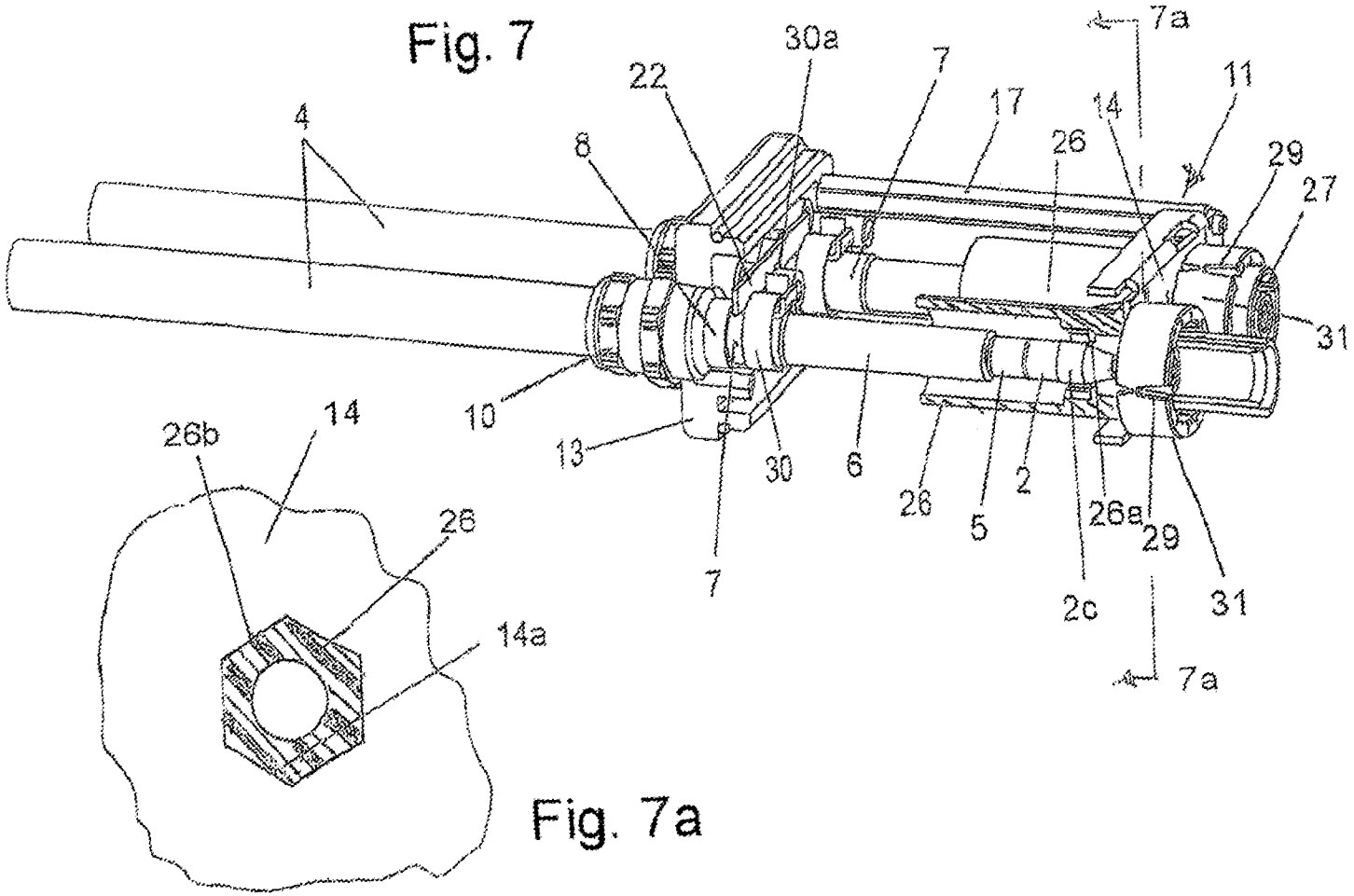
FIG. 7 is a perspective side view of the assembled preassembly frame with certain parts broken away.
FIG. 7*a* is a detailed sectional view taken along line 7*a*-7*a* of FIG. 7.

As shown in FIGS. 5-7, the transmission line free ends extend longitudinally into a rigid rectangular preassembly frame 11 via openings contained in a rectangular vertical first frame end wall 13, which is preferably formed from a suitable electrically insulating synthetic plastic material. Connected with the first end wall 13 by a plurality of longitudinal studs and associated screws 19 is a second end wall 14. which is preferably formed of sheet metal.

Figure 3:
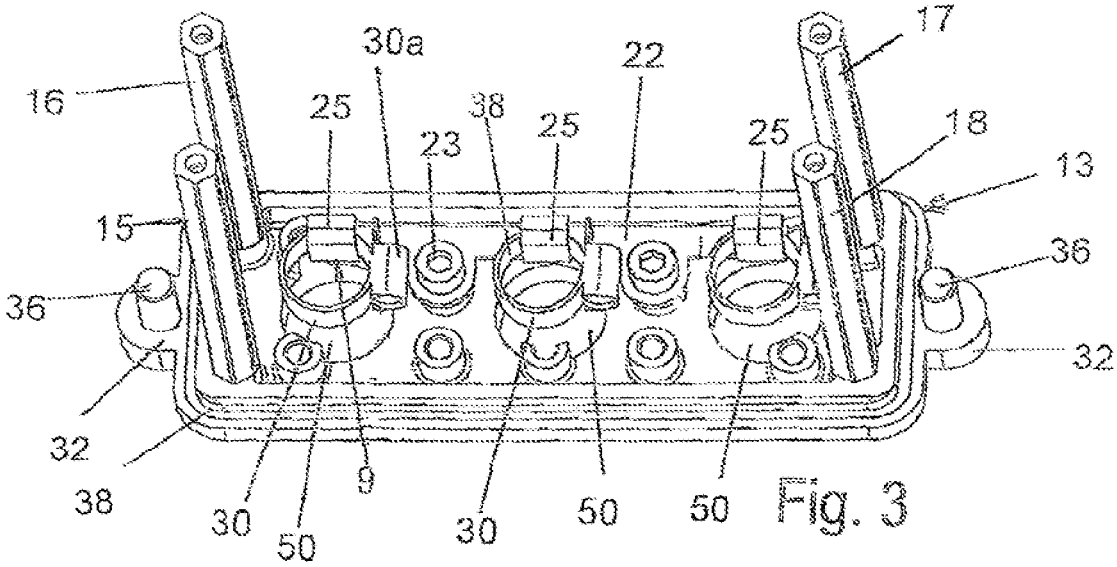
FIG. 3 is a perspective view of the inner side of a first end wall of the preassembly frame.
Figure 4:
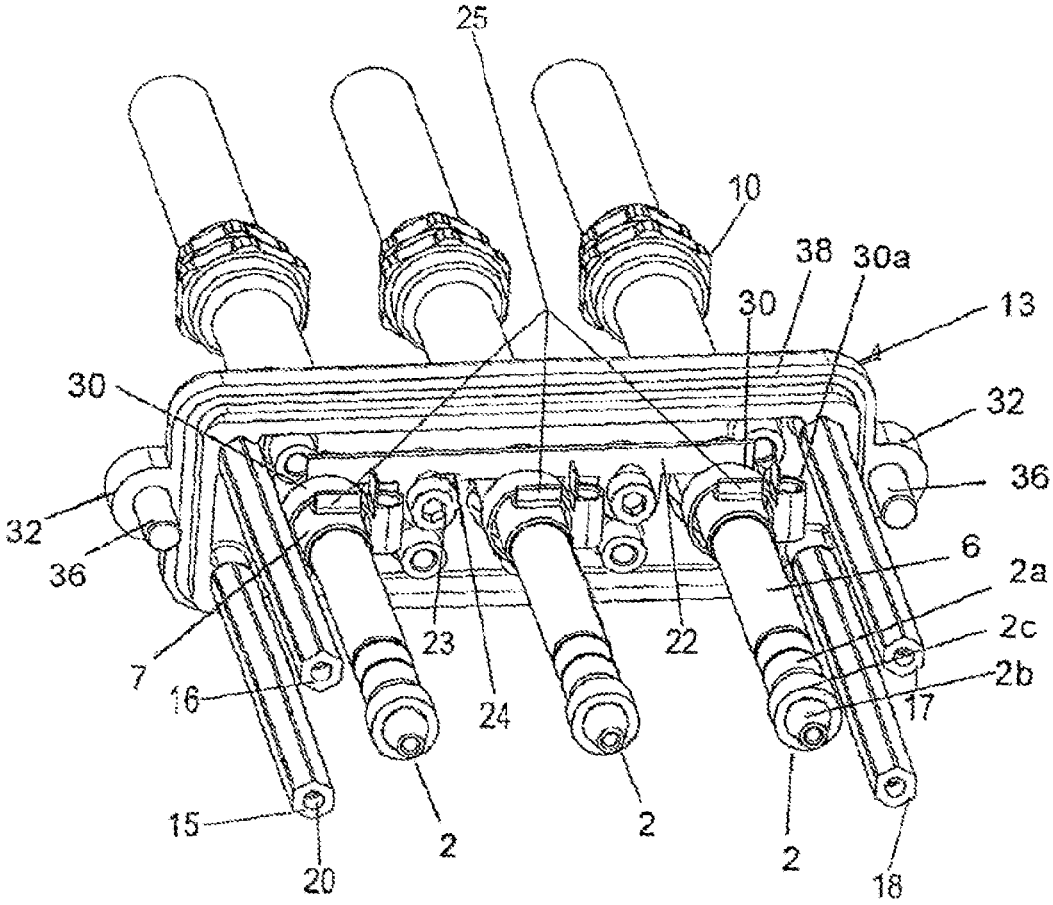
FIG. 4 is a perspective view of the inner side of a second end wall of the preassemble frame.

As is shown in FIGS. 3 and 4, the frame studs 15-18 are integral with and extend from the inner surface of the first end wall 13 adjacent the corners thereof. Mounted by screws 23 on the inner face of the first frame end wall 13 adjacent the circular wall openings 50 is a conductive grounding plate 22 that is adapted for connection with ground. The screws 23 extend through corresponding oversized openings 24 contained in the grounding plate, thereby to permit adjustment of the plate relative to the wall openings 50. The grounding plate 22 is provided with integral projections 25 that are arranged for engagement with the exposed portions of the braided shielding layers 7 of the transmission lines 4, respectively. Hose-type clamping devices operated by conventional screw-operating means 30*a* are connected with the grounding plate for clamping the exposed braided shielding portions 7 of the transmission lines in firm electrical engagement with the grounding plate projections 25. The end wall 13 is provided with a pair of integral ear portion 32 containing threaded bores in which are provided fastening screws 36 for connecting the preassembly frame with the associated housing, as will be described in greater detail below. Also, the inner surface of the end wall is provided with a continuous step or ridge portion 38 (FIGS. 3, 4 and 8) that is adapted to support a compressible sealing gasket (not shown).

Figure 8:
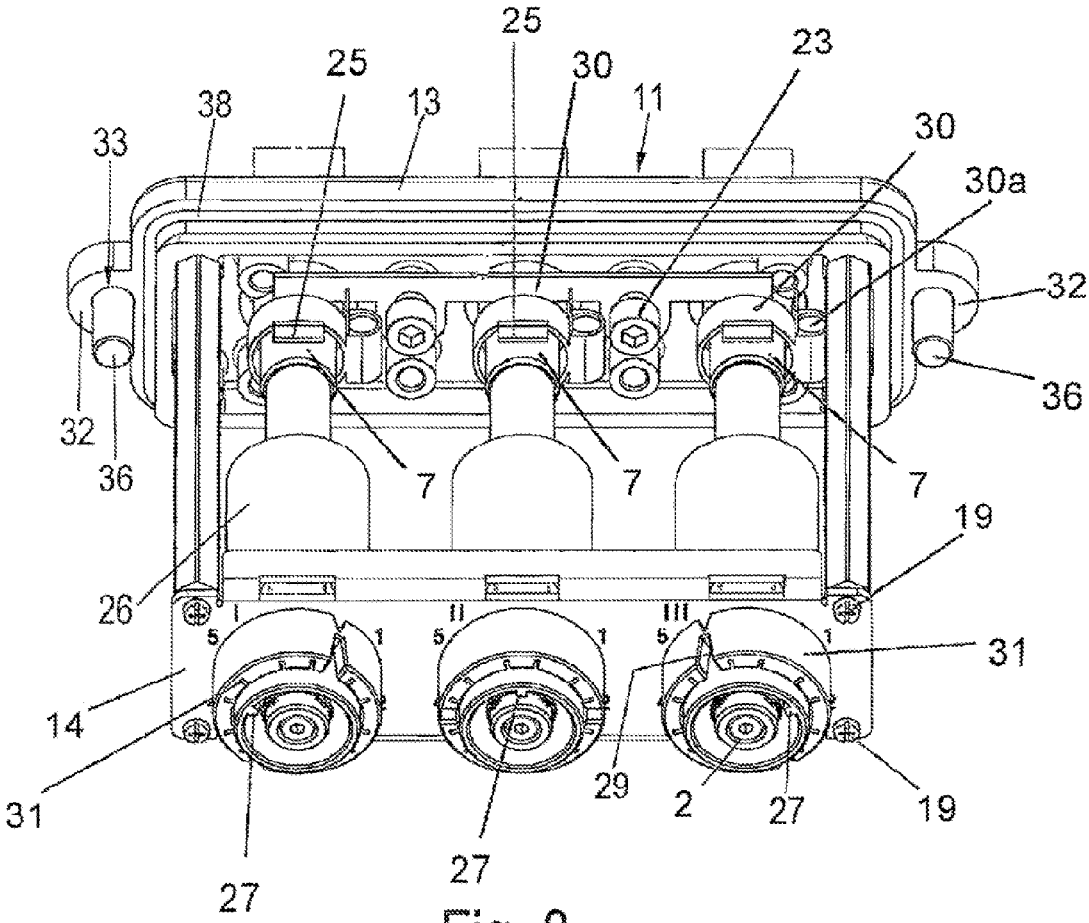
FIG. 8 is a front perspective view of the assembled preassembly frame.

Referring now to FIGS. 6-8, the second end wall 14 of the preassembly frame 11 contains non-circular wall openings 14*a* for receiving corresponding non-circular outer circumferential portions 26*b* of generally tubular insulation sleeves 26, respectively. Preferably these wall openings 14*a* and the associated outer circumferential surface portions 26*b* of the insulation sleeves 26 have a hexagonal cross-sectional configuration. At their one ends, the insulation sleeves extend though the openings and are connected with the second end wall 14 by annular split locking devices 31, respectively. As best shown in FIG. 7, the internal surfaces of the insulation sleeves are provided with annular support ribs 26*a* that support the intermediate portions 2*c* of the contact members 2, respectively.

Figure 9A:
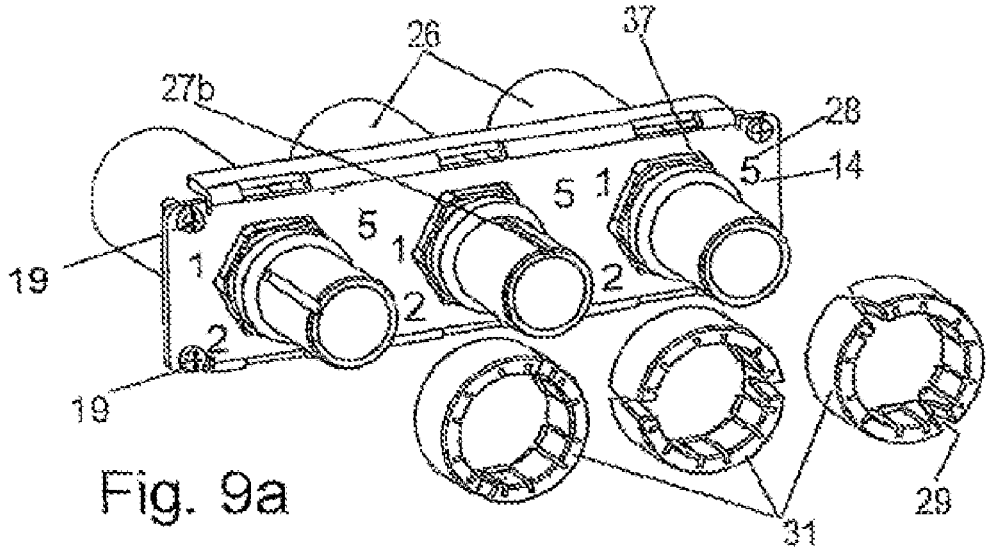
FIG. 9*a* is an exploded front view of the front end portion of a first connector arrangement.
Figure 9B:
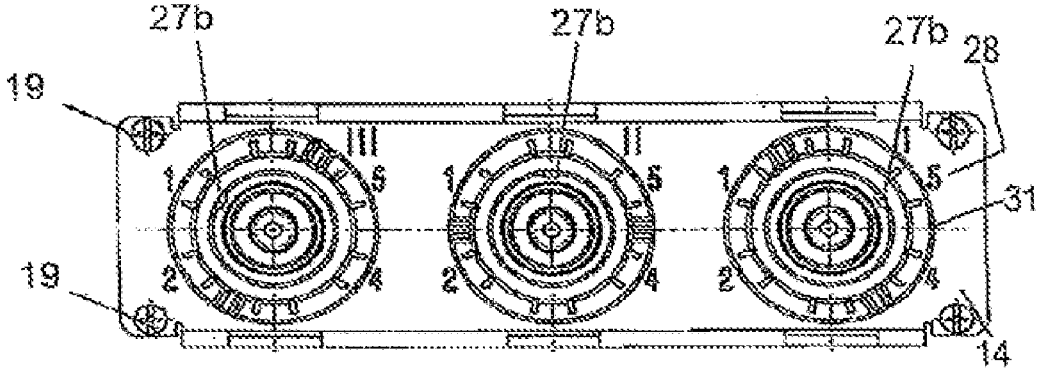
FIG. 9*b* is a front view of the apparatus of FIG. 9*a* in an assembled condition.
Figure 9C:
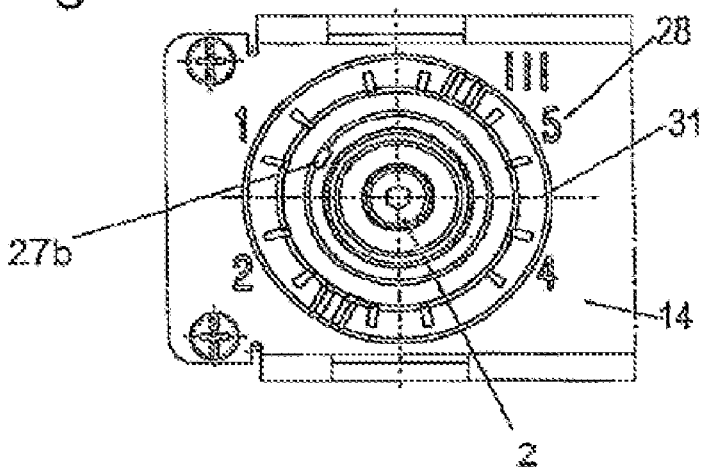
FIG. 9*c* is a detailed view of a portion of the apparatus of FIG. 9*b*, and FIGS. 10*a*, 10*b*, and 10*c* are corresponding views of a companion second connector arrangement.
Figure 10A:
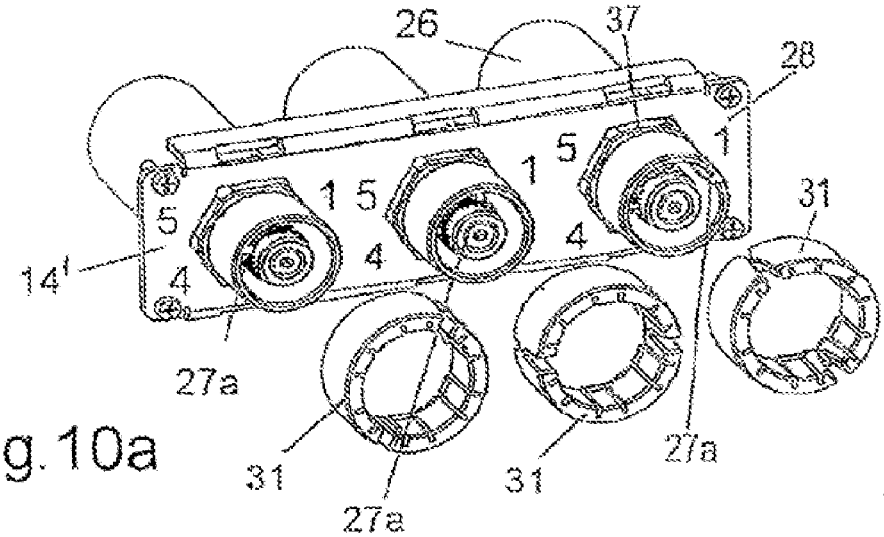
Figure 10B:
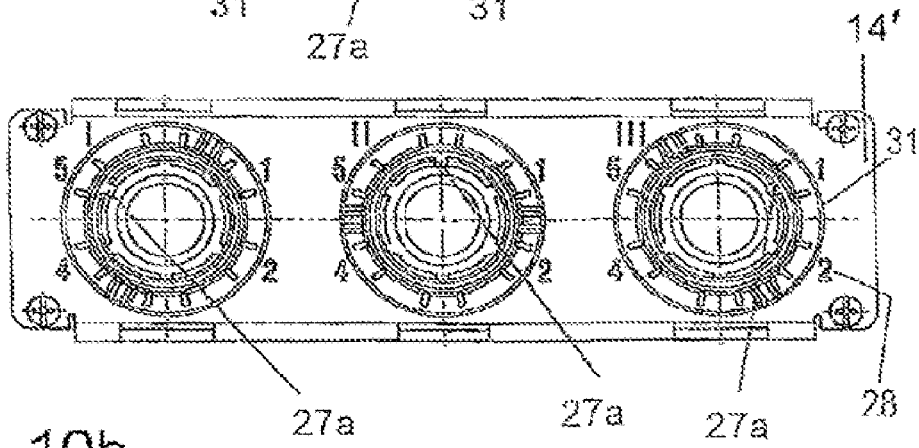
Figure 10C:
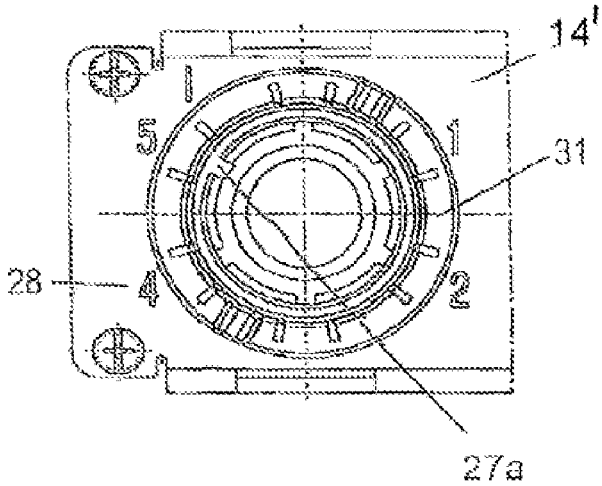

According to an important feature of the invention, coding means 27 are provided for preventing the connection of the connector assembly with an unauthorized second connector or other electrical device. To this end, the external surfaces of the protruding portions of the insulating sleeves 26 of FIGS. 9*a*-9*c* are provided with longitudinal slots 27*b*, respectively. The angular positions of these slots relative to the second end wall 14 may be controlled as a consequence of the cooperation between the hexagonal outer circumferential surface 26*b* (FIG. 7*a*) of the insulation sleeves 26 and the correspond hexagonal configurations 14*a* of the corresponding wall openings. In other words, the insulation sleeves 26 may be rotated about their longitudinal axes to any one of six positions relative to the second end wall 14, as indicated by the markings 28 on the external surface of the end wall 14. Similarly, the internal surfaces of the oversized extending end portions of the insulation sleeves 26' of the corresponding authorized connector arrangement of FIGS. 10*a*-10*c* are provided with longitudinal projection ribs 27*a* which are adapted to extend within the slots 27*b* of the authorized companion connector arrangement when the insulation sleeves 26' of FIGS. 10*a*-10*c* have the same rotational arrangement as the corresponding insulation sleeves 26 of FIGS. 9*a*-9*c*, as indicated by the markings 28.

Figure 13:
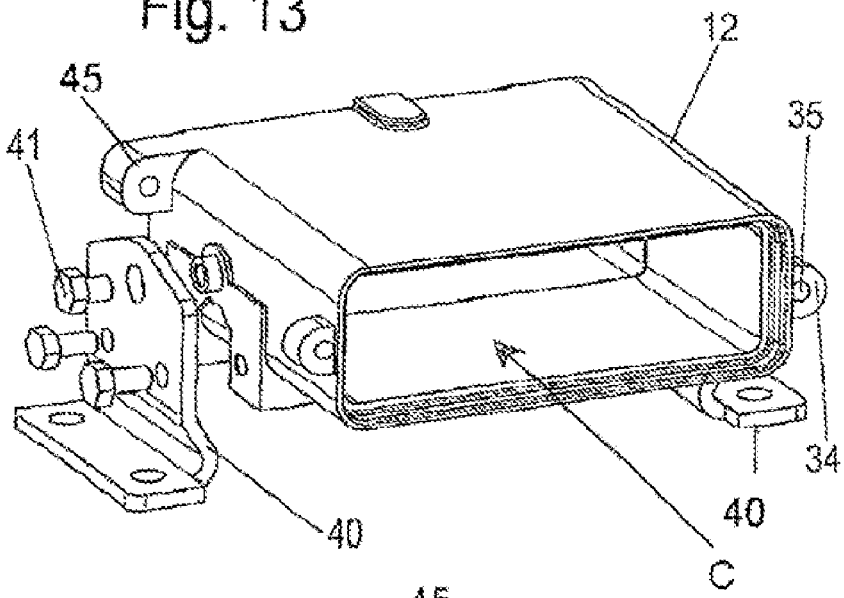
FIG. 13 is a front perspective view of one of the connector housings of FIG. 1.

Following the complete assembly of the components on the preassembly frame 11, the frame is inserted longitudinally into the connector housing 12 of FIG. 13, and is locked into place by the cooperation between screws 36 and the threaded bores of the ear portions 34 and 36 of the housing and the first end wall 13. The housing 12 may be connected with a fixed support by means of the L-shaped mounting feet 40. As shown in FIG. 1, an authorized correspondingly-coded companion connector assembly 3 may then be fastened to the connector assembly of FIG. 14 by the connecting bolt and ear connecting means 39 and 45.

By way of example, while three transmission lines 4 have been shown to be connected to the connector 1, the number of transmission lines 4 should be considered as purely exemplary. Transmission lines 4 preferably are those with single-core lead or multi-core lead transmission-line core leads 5 with a relatively large cross-section that are suitable for the transmission of high power outputs such as they are needed, for example, to supply electric motors for the purpose of driving rail vehicles (for example, more than 500 A current intensity and more than 1 kV voltage).

The layers surrounding the transmission line core lead 5 are staggered or stripped to be remote from the end of conductor 4 in various axial lengths so that it is possible to provide the transmission line core lead 5 with the contact casing 2 and to abut the sheath 7 thereof in an electrically conducting manner separately against a shield-contacting device 9 of the connector 1 (see FIGS. 3 and 4).

Because of the high outputs to be transmitted, it is necessary to design the connector 1 such that mistakes can be ruled out as much as possible during its assembly. Furthermore, braided shield layer 7 preferably is to be so contacted that it will, on the one hand, be contactable in a simple manner, but, on the other hand, it will also be suitable for the shunting of higher outputs, at any rate, for a predefined span of time. Thus, the connector 1 has a frame 11 (FIG. 8), which is so designed that, upon it, transmission line 4 as well as the cable shielding layer are first assembled or contacted in a conclusive manner before a housing 12 is assembled upon frame 11. In this way, it is possible first of all to create a preassembled unit whose configuration is error free. That can also be checked out easily by visual means. Only then is housing 12 assembled. In this way, it is possible in a particularly simple manner to contact the shield layers 7 of the transmission lines 4 in a secure and simple fashion. In this way, one can make sure that the connectors 1 and 3 cannot be stuck together in a twisted position. The corresponding patch plug is fashioned like the previously described patch plug except for the contact casings 2' (FIG. 12) and the corresponding coding means (FIG. 11) (preferably extensively or precisely).

Figure 14:
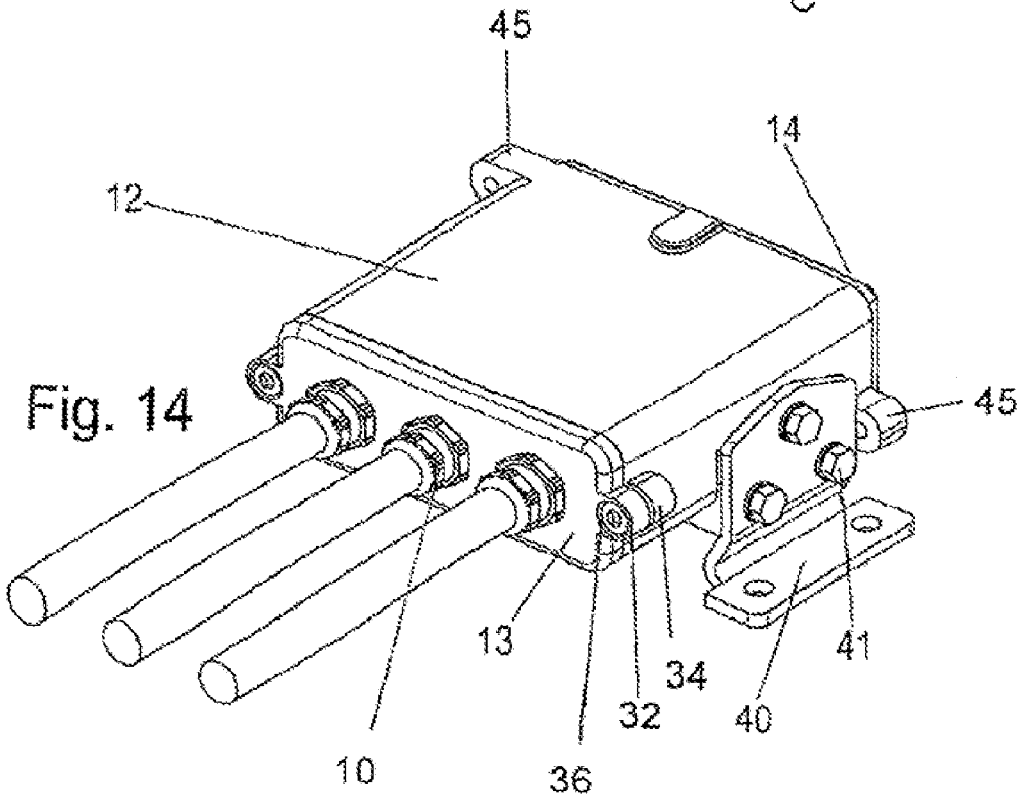
FIG. 14 is a rear perspective view of one of the assembled connectors of FIG. 1.

First of all, frame 11 is preassembled with the parts shown in FIG. 8. Only then is housing 12 in this case pushed on from the side of plate 14 (FIGS. 13, 14). Preferably, plate 13 is so dimensioned that the circulating edge of housing 12 will rest on a step 38 when it is in the assembled state, possibly provided with a continuous seal (not shown in FIG. 8). Here, housing 12 and plate 13 in each case are screwed together with each other on corresponding screw connection means such as ridges 32 with boreholes 33 and screws 36, something that connects the entire frame 11 in a stable manner with the two plates 13, 14 and the housing 12. The stable frame 11 makes sure that, as housing 12 is shoved upon frame 11, the parts on the inside of frame 11 cannot be shifted around or cannot be damaged. The housing preferably extends from plate 13 all the way to plate 14 on the plug-in front which, along its outer circumference, is bordered by the housing. Shoulders 34 with boreholes 35 can be provided on housing 13 in order to screw together the two connector assemblies in the completely assembled state using corresponding screws 39 (FIG. 1). An assembly foot 40, which can be bolted upon the housing with screws 41 is used to fix the connector assembly on a foundation base.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting the ends of a plurality of insulated high-voltage transmission lines (4) with an electrical device, comprising:

(a) a housing (12; 12') containing a longitudinally-extending open-ended chamber (C);

(b) a rigid preassembly frame (11) including:

(1) a pair of parallel spaced vertical end walls (13, 14); and (2) a plurality of parallel horizontal longitudinally-extending studs (15-18) connected between said end walls;

(c) first transmission line mounting means (10) for mounting intermediate portions of the insulated transmission lines in openings contained in a first one (13) of said end walls, respectively, each of the insulated transmission lines including a core conductor (5), a first layer (6) of insulating material arranged concentrically about the core conductor, a braided conductive shield layer (7) arranged concentrically about the first insulation layer, and an outer layer (8) of insulating material arranged concentrically about the braided shield layer;

(d) second transmission line mounting means (2, 26, 31) for mounting the free ends of the insulated transmission lines in openings contained in the second one (14) of said end walls, respectively;

(e) frame mounting means (32, 34, 36) for mounting said preassembly frame longitudinally in said housing chamber; and (f) grounding means (22) mounted on said first end wall for electrical engagement with exposed portions of the braided shield layers of the transmission lines at locations at which the outer insulation layer has been removed, thereby to ground the transmission lines, said first end wall being formed from an electrically insulating synthetic plastic material, said grounding means including:

(1) a vertical conductive grounding plate (22) adapted for connection with ground;

(2) grounding plate connecting means (23) connecting said grounding plate to one of the side surfaces of said first end wall; and (3) a plurality of integral shield contact projections (25) extending from said grounding plate for electrical engagement with the exposed braided shield layer portions of the transmission lines.

2. An electrical connector as defined in claim 1, wherein said first transmission line mounting means includes clamping means (30) for clamping each of the transmission lines to said grounding plate.

3. An electrical connector for connecting together the associated bare end portions of two sets of insulated high-voltage transmission conductors (4; 4'), comprising:

(a) a sectional connector housing (1) including two corresponding sections (12; 12') each containing a through chamber (C) having a generally rectangular cross-sectional configuration;

(b) preassembly frame means including a pair of rigid generally-rectangular preassembly frames (11) each comprising:

(1) first (13) and second (14) generally-planar rectangular vertical end walls;

(2) connecting means (15-18) rigidly connecting together said end walls in parallel spaced relation, said first and second end walls containing a plurality of first (50) and second (14*a*) aligned openings;

(3) a plurality of insulation sleeves (26) mounted in and arranged orthogonally of said second openings, respectively, said insulation sleeves having first ends that protrude outwardly of said send end wall, whereby the associated set of conductors may be respectively introduced successively through said first openings and through said insulation sleeves with the bare end portions of the conductors protruding beyond the associated second frame wall;

(4) clamping means (30) for clamping the conductors of the associated set in said first openings, respectively, whereby said preassembly frame and the associated conductors may be inserted longitudinally second-end-first into the section chamber toward an inserted position in which said frame first wall is adjacent a first end of the housing section, and said frame second end wall is adjacent a second end of the housing section, such that said insulation sleeve first ends and the conductor bare end portions extend from said housing section second end wall;

(5) a plurality of electrical contacts (2) connected with the protruding bare end portions of said conductors, respectively; and (6) frame fastening means (32, 34) for fastening said preassembly frame in said inserted position to said housing section, thereby to define a conductor-assembled section;

(c) coding means (27) carried by the adjacent protruding first ends of said insulation sleeve of each conductor-assembled housing section for permitting only authorized conductor-assembled housing sections to be arranged collinearly in a connected position with their second ends in contiguous engagement, said coding means comprising:

(1) a plurality of longitudinal coding slots (27*a*) carried by the protruding portions of the insulation sleeves of one conductor-assembled section; and (2) a plurality of longitudinal coding ribs (27*b*) carried by the protruding portions of the insulation sleeves of the other conductor-assembled section for cooperation with said coding slots;

(3) said second openings (14*a*) and the adjacent external circumferential surfaces of said insulation sleeves having corresponding non-circular configurations, thereby to permit rotation of each of said insulation sleeves between selected coding positions relative to the associated second frame wall, the external surface of each of said second end walls (14) being provided with visual markings (28) which indicate the rotational coding relationship of each of said insulation sleeves about its longitudinal axis relative to the associated second end wall; and (d) housing section connecting means (39, 45) for connecting together the adjacent second ends of a pair of authorized housing sections, thereby to produce electrical engagement between the contacts on corresponding conductors of said authorized conductor-assembled sections.

4. An electrical connector as defined in claim 3, wherein said electrical contacts include first ends (2*a*, 2*a*') fastened by crimping to the associated insulated conductor bare end portions, respectively.

5. An electrical connector as defined in claim 4, wherein said contact member includes at its other end a male contact (2*b*).

6. An electrical connector as defined in claim 4, wherein said contact member includes at it other end a female contact (2*b*').

7. An electrical connector as defined in claim 4, and further including an annular split locking device (31) mounted on each of said insulation sleeve protruding one ends.

8. An electrical connector as defined in claim 4, wherein the cross-sectional configurations of each of said insulation sleeve outer circumferential surface portions (26*b*) and the corresponding wall openings (14*a*) are hexagonal.

* * * * *